United States Patent [19]

Thompson et al.

[11] 4,275,935

[45] Jun. 30, 1981

[54] DRILLING STABILIZER

[75] Inventors: Charles M. Thompson, Carrollton; Charles T. Thompson, Dallas, both of Tex.

[73] Assignee: American Coldset Corp., Addison, Tex.

[21] Appl. No.: 56,975

[22] Filed: Jul. 17, 1979

[51] Int. Cl.[3] ..... F16C 29/02

[52] U.S. Cl. ..... 308/4 A; 166/241

[58] Field of Search ..... 175/325, 323, 320; 166/241; 308/4 A, 4 R

[56] References Cited

U.S. PATENT DOCUMENTS

| | | | |
|---|---|---|---|
| 2,813,697 | 11/1957 | Swart | 255/28 |
| 3,164,216 | 1/1965 | Hall, Sr. et al. | 175/23 |
| 3,292,708 | 12/1966 | Mundt | 166/241 |
| 3,370,894 | 2/1968 | Pourchot | 308/4 A |
| 3,410,613 | 11/1968 | Kuus | 308/4 |
| 3,420,323 | 1/1969 | Owens | 175/323 |
| 3,528,499 | 9/1970 | Collett | 166/75 |
| 3,560,060 | 2/1971 | Morris | 308/4 A |
| 3,894,779 | 7/1975 | Hoon et al. | 308/4 A |
| 3,894,780 | 7/1975 | Broussard | 308/4 A |
| 3,916,998 | 11/1975 | Bass, Jr. et al. | 166/301 |
| 3,933,203 | 1/1976 | Evans | 308/4 A |
| 3,938,853 | 2/1976 | Jürgens et al. | 308/4 A |
| 3,945,446 | 3/1976 | Ostertag et al. | 175/323 |
| 4,011,918 | 3/1977 | Jurgens | 175/325 |
| 4,036,539 | 7/1977 | Saunders et al. | 304/4 A |

FOREIGN PATENT DOCUMENTS 1372181 10/1974 United Kingdom .

OTHER PUBLICATIONS

Emtec Advertisement (4 pp.).
Schellstede Advertisement (4 pp.).

*Primary Examiner*—Lenard A. Footland
*Attorney, Agent, or Firm*—Kenyon & Kenyon

[57] ABSTRACT

A stabilizer for a drill string is disclosed. The stabilizer is of split configuration having an open slot or split which extends for the length of the stabilizer. The split stabilizer is slipped over a drill collar and fasteners are used to draw the split stabilizer together to clamp the stabilizer to the drill collar. The stabilizer may thus be positioned at any desired axial location on the drill collar and non-rotatably locked thereto by the fasteners. Advantageously, the stabilizer is made of a non-magnetic material.

22 Claims, 12 Drawing Figures

10
12
12'
A
14A
14A
B
14B
14B

Fig. 2.
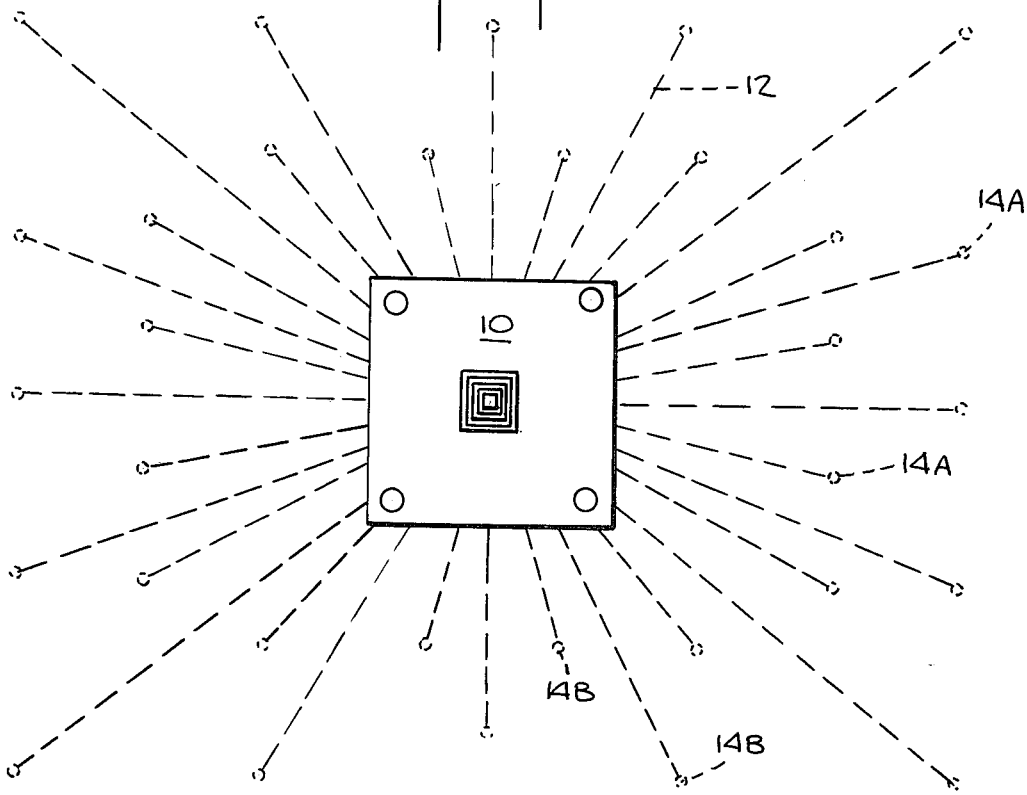
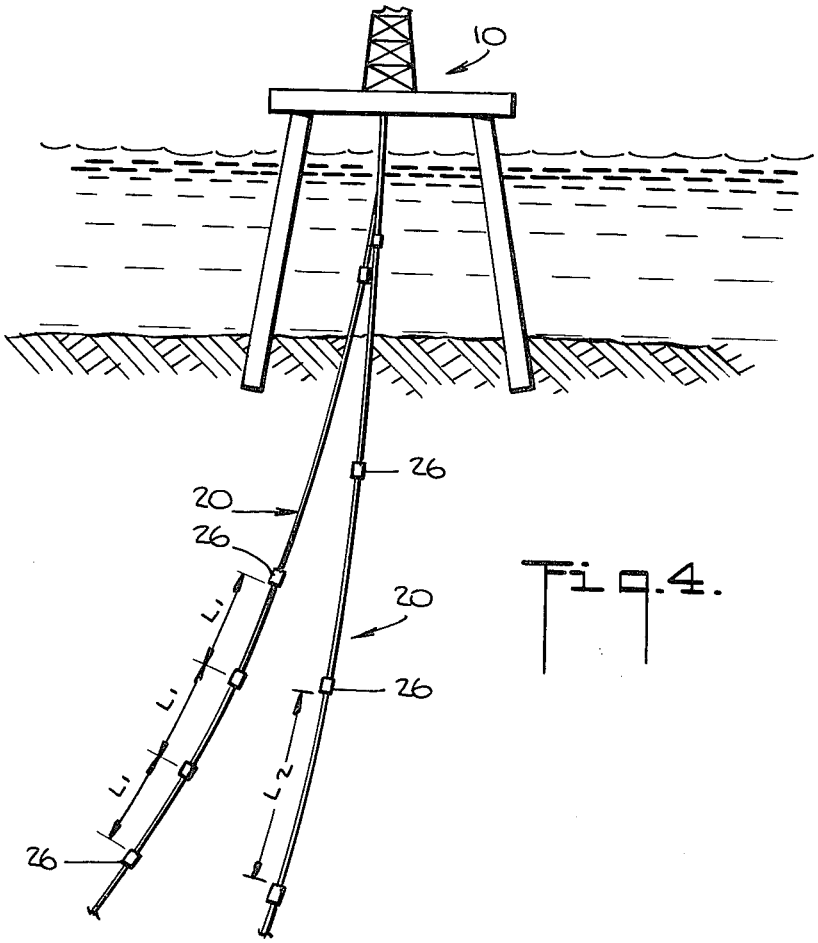
Fig. 4.

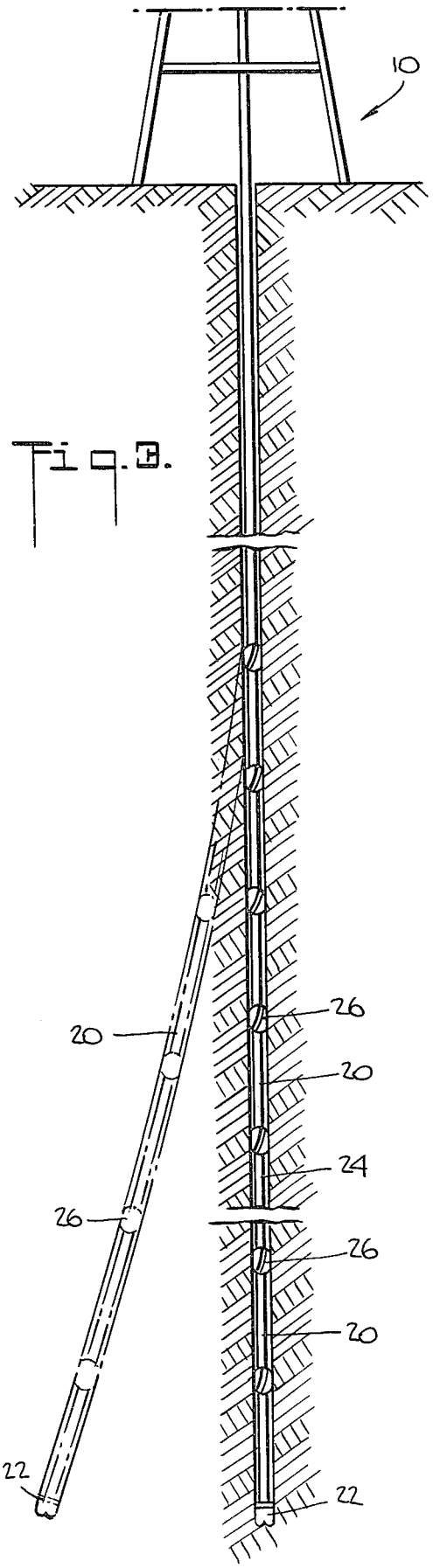
Fig. 8.
Fig. 5.
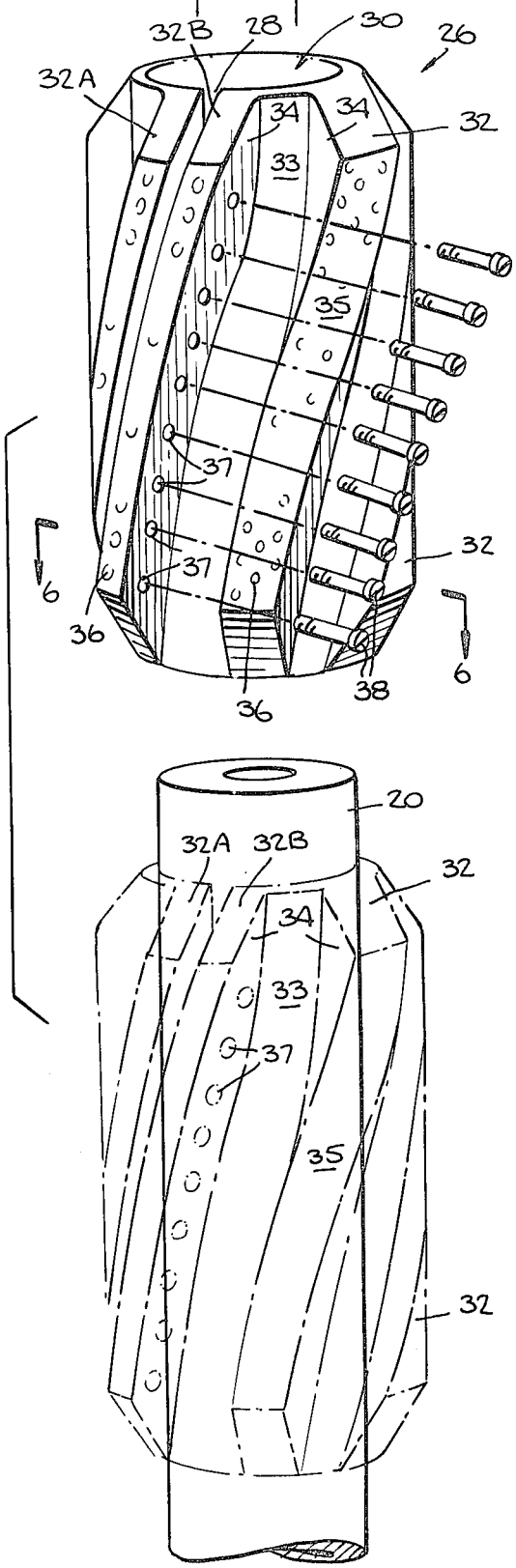

DRILLING STABILIZER

BACKGROUND OF THE INVENTION

The present invention relates to well drilling apparatus and more particularly to drill collar stabilizers.

Drill collar stabilizers are used in directional drilling operations to control the angle of a bore hole being drilled from the surface. By means of drill collar stabilizers, a bore hole extending at an angle to the vertical may be drilled. Drill collar stabilizers may also be used for guiding a drill string and drill bit in alignment when drilling a vertically-extending bore hole.

To extend a bore hole at an angle to the vertical, stabilizers are commonly mounted between a series of drill collars. Drill collars are heavy elongated tubular members which can be deflected along their length during a drilling operation. The degree of deflection of an assembly of drill collars is controlled by the disposition of stabilizers with respect to a series of collars. The stabilizers which bear against the wall of the bore hole act as fulcrums to enable an assembly of drill collars to be flexed about the fulcrums. Thus, the spaced location of the stabilizers on the drill collars in conjunction with the weight or force of the drill collars determined the degree of deflection of the assembly of drill collars. Not only is the degree of deflection of the drill collars directly adjacent the drill bit controlled by stabilizers, but also the degree of deflection of other drill collars spaced along the bore hole.

It has become common to drill to greater and greater depths for oil and gas and to employ directional drilling i.e. drilling at an angle to the vertical. Correspondingly, drilling operations and equipment have become more sophisticated and complex, particularly offshore drilling operations and equipment. For example, a plurality of bore holes may be drilled from an offshore drilling rig secured at a single location with each hole extending in a different direction. This is accomplished by directionally drilling a plurality of bore holes at different angles with the vertical and in different directions. The holes are relatively closely spaced at the surface to enable the plurality of holes to be drilled from a single drilling rig location. As drilling proceeds, the angle of drilling of each bore hole is controlled in order that the bore hole locations and depths are spaced over a relatively large area in a grid-like pattern. The bore holes may also be directed to be in a plurality of strata, each of which may be at a different depth and location. To reach a plurality of different locations, it is necessary to control the drilling angle with extreme accuracy for each bore hole in order that the bottom of the bore hole is within as little as several feet of a predetermined location. The location at which stabilizers are disposed along an assembly of drill collars and the weight of the drill collars control the deflection of the assembly and thereby the drilling angle. Accordingly, it is necessary to position the stabilizers at a plurality of different positions along the length of the drill collars to control the drilling angle. Computers are used to determine the proper position of the stabilizers on an assembly of drill collars.

In order to control the drilling angle and direction of a bore hole, magnetic readings of the heading of the bore hole, i.e., readings based on the earth's magnetic field and movement of the indication of the angle of the bore hole, may be taken in the bore hole which, in conjunction with the depth at which the readings are taken, yield a spatial determination of the bore hole. To permit magnetic monitoring, the drill collars are made of non-magnetic material.

It is not uncommon to drill the depths of 14,000 feet or more. The weight of the drill string is supported by the rig at the surface but the drill bit is loaded vertically by the predetermined weight of a plurality of drill collars. Accordingly, considerable forces are encountered by the drill collars and the stabilizers during a drilling operation or during raising or lowering of the drill string. For example, axial forces in the range of 200,000 pounds may be applied to a stabilizer during the raising or lowering of an assembly of drill collars and torques in the range of 60,000 foot pounds may be encountered by the stabilizers during drilling. During directional drilling, a stabilizer acts as a fulcrum point between the wall of a bore hole and the assembly of drill collars. As a result, tremendous torques may be applied to a stabilizer. Accordingly, drill collar stabilizers must be constructed to withstand such forces and torques. In addition the wear surfaces of stabilizers must be made of a hard material such as steel, tungsten carbide, or the like.

DESCRIPTION OF THE PRIOR ART

U.S. Pat. No. 3,916,998, issued Nov. 4, 1975, discloses a rigid stabilizer which can be slipped over a drill collar section and axially positioned at a desired location. The stabilizer includes a cylindrically configured main sleeve having an axial passageway which is slipped over a drill collar section and is axially positioned thereon. Split rings are provided adjacent the ends of the main sleeve. Cap sleeves are slipped over the collar section and threadedly secured to the ends of the main sleeve. Tightening the cap sleeves to the main sleeve in conjunction with the action of the split rings, causes the stabilizer to be engaged to the collar. Considerable torque must be applied to engage the stabilizer to the drill collar. If the stabilizer is to be used in conjunction with magnetic instrumentation, the stabilizer must be of non-magnetic material. Due to these severe torque levels, the stabilizer of the '998 patent when made from non-magnetic material becomes subject to galling or fretting corrosion during operation.

U.S. Pat. Nos. 4,001,918, issued Mar. 15, 1977, and 3,945,446, issued Mar. 23, 1976, disclose stabilizers having a conical interior surface which are shrink-fitted onto a mating exterior conical surface of a drill collar. Since it is necessary to threadedly engage sections of the drill collar to shrink-fit the stabilizers thereon, the stabilizers of these patents must be disposed on the drill collars only at the location of the exterior conical surface.

U.S. Pat. Nos. 3,410,613; 3,933,203; 3,894,779; 3,894,780; 3,528,499; 3,164,216; and 2,813,697 disclose devices which are used to protect, support or guide a drill string, or a production string. Each is made of elastomeric material and accordingly is not generally suitable for use as a drill collar stabilizer. The devices in the '613, '780, '216 and '697 patents is made of two semi-cylindrical pieces, while the devices in the '203, '779 and '499 patents are split and closed by a pin or bolt member. In certain of these patents the pipe or stem rotates relative to the device.

In U.S. Pat. No. 3,292,708 issued Dec. 20, 1966, another multiple piece device is disclosed. The tubing centralizer described in the '708 patent is for a production string and comprises two clamp portions which are hinged together at one end and bolted together at the other end. Radially extending wings, held by the clamp portions, are provided to engage the casing of the production well.

The two or more split-piece devices described above are subject to separating and falling into the bore hole. The elastomeric split devices may also be separated from the drill collar due to the elastic nature of the device.

SUMMARY OF THE INVENTION

It is an object of the present invention to provide a stabilizer device which may be positioned at any desired location on a drill collar.

It is an object of the invention to provide a stabilizer which can be clamped to the exterior surface of a drill collar without wearing or damaging the stabilizer or drill collar during usage.

It is an object of this invention to make a stabilizer which provides adequate stabilization without increasing threaded connections in the drill string. It is an object of this invention to make a stabilizer which can be positioned and repositioned at the surface quickly.

It is another object of the invention to provide a stabilizer of non-magnetic material to prevent the stabilizer from interfering with magnetic monitoring of the bottom of the bore hole.

These and other objects of the invention are achieved by a split stabilizer which comprises a hollow, generally cylindrical body having an open slot extending along the length thereof. The stabilizer is adapted to receive in an opening extending therethrough an elongated tubular assembly which rotatably drives a drill bit. Means are disposed on the outer portion of the hollow body for bearing upon the interior surface of a bore hole to stabilize the elongated tubular assembly and means are provided to clamp or lock the stabilizer to the tubular assembly preferably such that component parts of such means will not separate from the stabilizer during usage. According to one aspect of the invention, the stabilizer is made of non-magnetic material.

In accordance with the invention, the stabilizer is for an elongated tubular assembly for rotatably driving a well drill bit within a bore hole and comprises a hollow cylindrical body of hard deflectable material having an opening extending centrally throughout the length thereof substantially corresponding to the external transverse dimensions of the elongated tubular assembly, the opening being adapted to receive a length of the elongated tubular assembly therein. The hollow cylindrical body has an open slot extending throughout the length thereof from the outer portion of the hollow cylindrical body to the opening therein. Means formed of rigid material are disposed upon the outer portion of the hollow cylindrical body for bearing upon the interior surface of a bore hole to stabilize the elongated tubular assembly within the bore hole when rotatably driving a drill bit. Means are provided to engage the hollow cylindrical body adjacent one side of the slot thereof and to extend across the slot to engage the hollow cylindrical body adjacent the other side of the slot for tightening the cylindrical body into clamping engagement with the external surface of the elongated tubular assembly and to withstand torque and linear forces applied to the stabilizer in response to the engagement of the bearing means with the interior surface of a bore hole.

The hollow cylindrical body has a wall thickness which is relatively small compared to the external transverse dimensions of the hollow cylindrical body, the relatively small wall thickness enabling the hard deflectable material to be elastically deflected by the tightening means to clamp the stabilizer along the length of the elongated tubular assembly.

The open slot in the hollow cylindrical body extending throughout the length thereof in one embodiment extends substantially parallel to the longitudinal axis thereof and in another embodiment extends substantially at an angle to the longitudinal axis thereof. In a preferred embodiment, the open slot extending throughout the length thereof is substantially in the form of a helix.

The means formed of rigid material disposed upon the outer portion of the hollow cylindrical body are disclosed to comprise a plurality of elongated blades spaced apart from one another and extending substantially in the direction of the longitudinal axis of the hollow cylindrical body, each blade having an outwardly facing land for bearing upon the interior surface of the bore hole and forming a groove with respect to the blade adjacent thereto, the groove being adapted to provide a flow path for drilling fluid between the outer portion of the hollow cylindrical body and the interior surface of a bore hole. Preferably, the open slot extends along the length of one of the blades. The surface of the end of each blade preferably contains wear-resistant material. In one embodiment, the length of each blade extends substantially parallel to the longitudinal axis of the hollow cylindrical body and in another embodiment, the length of each blade extends at an angle to longitudinal axis of the hollow cylindrical body. In the other embodiment, the length of each blade preferably extends substantially in the form of a helix.

In the disclosed embodiments, the tightening means adapted to engage the hollow cylindrical body comprise fastener means which in a preferred embodiment comprise a plurality of threaded bolts or screws, a plurality of mating nuts and a plurality of pairs of registered holes disposed adjacent the slot. The bolts preferably have socket heads and the openings preferably are counter-bored, a respective nut and socket head bolt being disposed in each counter-bored opening.

In order to retain the nut in the counter-bored opening, an interference fit is preferably formed between the exterior of the nut and the interior of the opening such that upon tightening the bolt, the nut is forceably drawn into the counter-bored opening and engaged therein. The nut is thus retained in the counter-bored opening independently of connection to the bolt. Similarly, to retain the bolt in the opening independently of connection to the nut, a flexible retainer member is preferably disposed in the counter-bored opening adjacent the socket head of the bolt. Thus, the retainer member is resiliently engaged in the counter-bored opening such that the bolt head is prevented from axially moving out of the opening.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 2 is a schematic plan view of an array of bore holes to be made by the apparatus of FIG. 1;

FIG. 3 is a schematic view depicting in solid lines a vertically-extending bore hole with a drill string for directional drilling having a plurality of stabilizers secured thereto.

FIG. 4 is a schematic diagram illustrating the relationship between stabilizer spacing and drill collar deflection;

FIG. 5 is a perspective view of a stabilizer according to the present invention;

DESCRIPTION OF THE PREFERRED EMBODIMENTS

Figure 1:
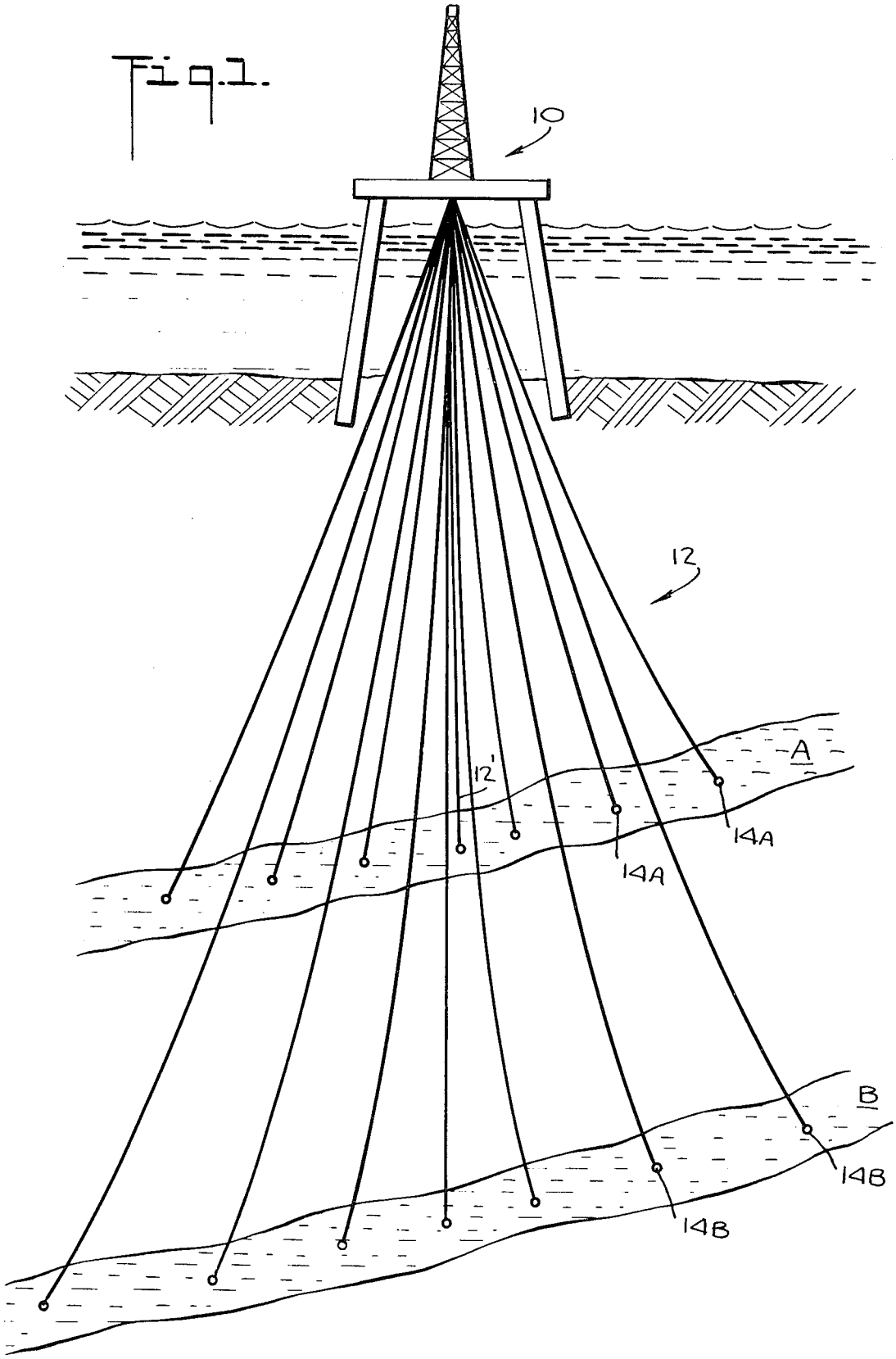
FIG. 1 is schematic elevation view depicting offshore drilling apparatus located at the surface of a body of water and a plurality of bore holes which may be drilled from a single location of the drilling apparatus.

Referring now more particularly to the drawings, a surface drilling apparatus 10 (FIGS. 1 and 2) is supported at an offshore location for drilling a plurality of bore holes 12. The bottom hole locations 14A, 14B are situated in oil zones or strata A, B, respectively, whose depth varies; correspondingly, the depths of the bottom portions of the bore holes may also vary. One of the bore holes 12' is a vertically-extending bore hole, while the remaining bore holes extend at an angle to the vertical. The locations of the bottom portions of each bore hole are disposed in a grid pattern and may extend over an area of approximately four square miles, i.e. over a square pattern measuring 10,000 feet on each side. To direct the bottom portion of the bore hole to the varied locations, the angle of each bore hole differs and is controlled by use of stabilizers. It is noted that the depth of the water may be approximately a number of hundreds of feet or more, while the depth of stratum B may be 14,000 feet or more.

The drill string shown in FIG. 3 is made up of interconnected drill collars 20 and a drill bit 22 connected as the lowermost drill string member. Each of the drill collars may, for example, be about thirty feet in length, have an outside diameter of approximately eight inches and an inside diameter of approximately two inches, and a weight of approximately 5,000 pounds. Since the depth of the bore hole may be up to 14,000 feet or more, the weight of the drill collars is supported at the uppermost portion thereof since otherwise the drill string would collapse. Thus, in response to the weight of the drill collars, a predetermined weight is supported by the drill bit. All but a small part of the drill collars are maintained in tension. A number of drill collar sections, for example, twenty, are supported by the drill bit and provide the weight necessary for drilling. A neutral point 24 defines the location where tension ends. Below the neutral point, the drill collars are loaded in compression.

The angle at which a bore hole is drilled is determined in part by the weight of drill collars which cause them to deflect. The angle is further determined by the locations of the stabilizers 26 on the drill collars. As the stabilizers are positioned closer together along the assembly of drill collars, flexing of the drill collars increases and increased angles of directional drilling are achieved. In accordance with the invention, the stabilizers may be located at any location on the drill collars and, therefore, precise angles may be obtained for the bore holes.

FIG. 4 illustrates the manner by which stabilizers determine the deflection of the drill collars and accordingly the bore hole angle. With a spacing of L1 between stabilizers, there is a great deal of flexure of the drill collars and accordingly an increased bore hole angle. With greater spacing of the stabilizers, for example, spacing by L2, less deflection results and accordingly a smaller bore hole directional angle is obtained. The spacing between stabilizers can also be varied such that the extent of the bore hole angle can be changed. This is desired where it is determined that the bore hole will miss its target location as determined by magnetic monitoring, for example.

Figure 8:
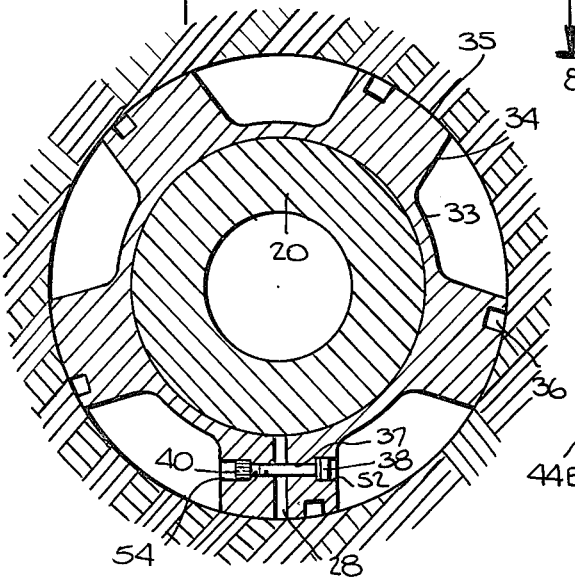
FIG. 8 is a transverse cross-section view taken along lines 8—8 of FIG. 7.
Figure 7:
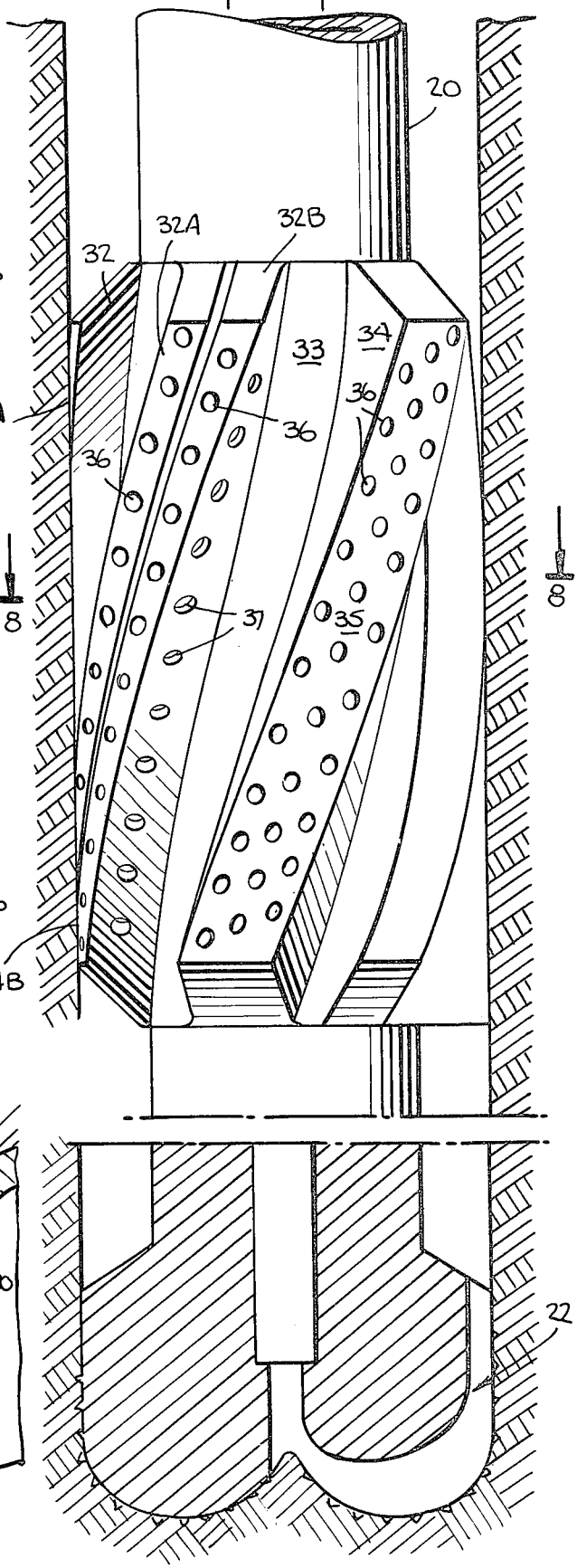
FIG. 7 is an elevation view of the stabilizer of FIG. 4 secured to a drill collar disposed in a bore hole.

Referring now to FIG. 5, a stabilizer 26 is illustrated which is of one piece construction having a helical slot or split 28 extending along the length of the stabilizer. Stabilizer 26 includes an axial opening 30 having an inside diameter of sufficient size to enable the stabilizer 26 to be slipped over a drill collar 20. A plurality of spaced helical blades 32 are provided for engaging the bore hole (FIGS. 7–8). The spaces or grooves between the blades permit passages of drilling fluid between the surface of the bore hole and the surface 33 of the body between the blades. The blades have side portions 34 and an outer peripheral portion 35. The outer peripheral portions 35 of the blades engage the interior surface of the bore hole (FIG. 7) and thereby stabilize the drill collar. Additionally, the blades may act as reamers to open the bore hole or to keep it open. Since the blades are subject to wear, hard particles 36 such as tungsten carbide, tungsten chips, Stellite material, etc. may be imbedded in the periphery thereof.

Figure 6:
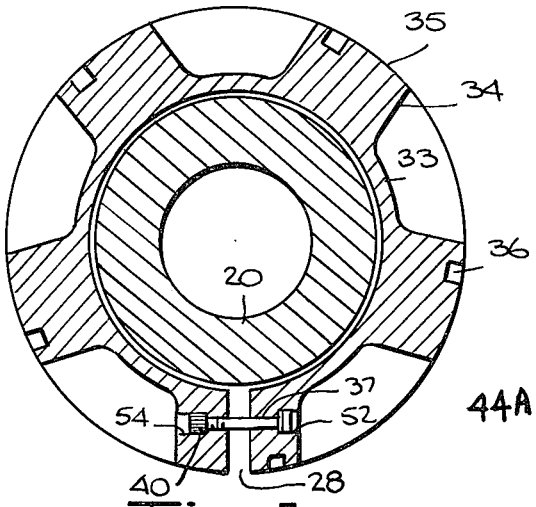
FIG. 6 is a transverse cross-sectional view of the stabilizer of FIG. 5 taken along lines 6—6 thereof and showing the stabilizer clamped upon a drill collar.

The blades are equally spaced about the periphery of the stabilizer, except for two blades 32A and 32B, which are adjacently disposed. Blades 32A and 32B each include a plurality of holes 37 therein, opposed pairs of which are in registration. Socket head bolts or screws 38 and respective nuts 40 (FIGS. 6 and 8–9) are used to lock the stabilizer on the drill collar. Tightening a socket head bolt onto a nut, draws the slotted stabilizer, i.e., the end blades 32A, 32B together, to clamp the stabilizer tightly about the drill collar 20.

The stabilizer shown in FIG. 5 has blades 32 which overlap in the longitudinal direction in order that when the stabilizer is in a bore hole, the bore hole is engaged at each longitudinal location by a plurality of blades. More specifically, the longitudinal location 44A is engaged by one blade 32 while the axially displaced longitudinal location 44B is engaged by end blade 32A.

Figure 9:
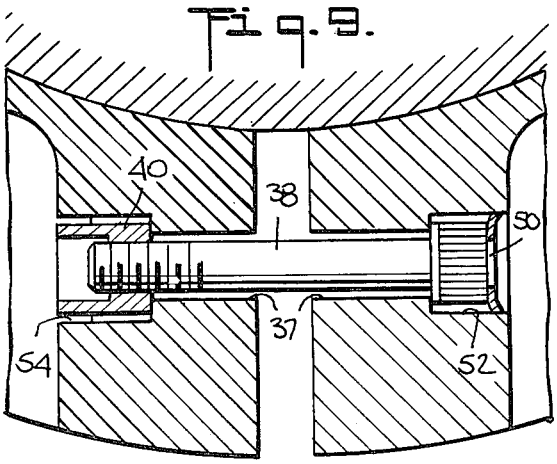
FIG. 9 is a fragmentary view taken along lines 9—9 of FIG. 7 and showing the retaining bolt.

As illustrated in FIG. 9, a spring drive washer 50 is inserted into a counter-bored portion 52 of opening 37 and nut 40 is splined and is sized to form an interference fit in the counter-bored portion 54 of the opening 37 in blade 32. Thus, upon tightening bolt 38 onto nut 40, the nut splines are worn or reamed as the nut is drawn into the opening and the nut becomes locked by virtue of the interference fit in the counter-bored opening 54. As a result, should any of the bolts 38 fail, both halves of a failed bolt will be retained in the respective openings and not be separated from the stabilizer 26. The plurality of bolts 38 enable enormous equally distributed clamping forces to be applied by the split stabilizer to the outer surface of a drill collar. In addition the bolts can be conveniently installed by conventional hand tools.

Figure 10:
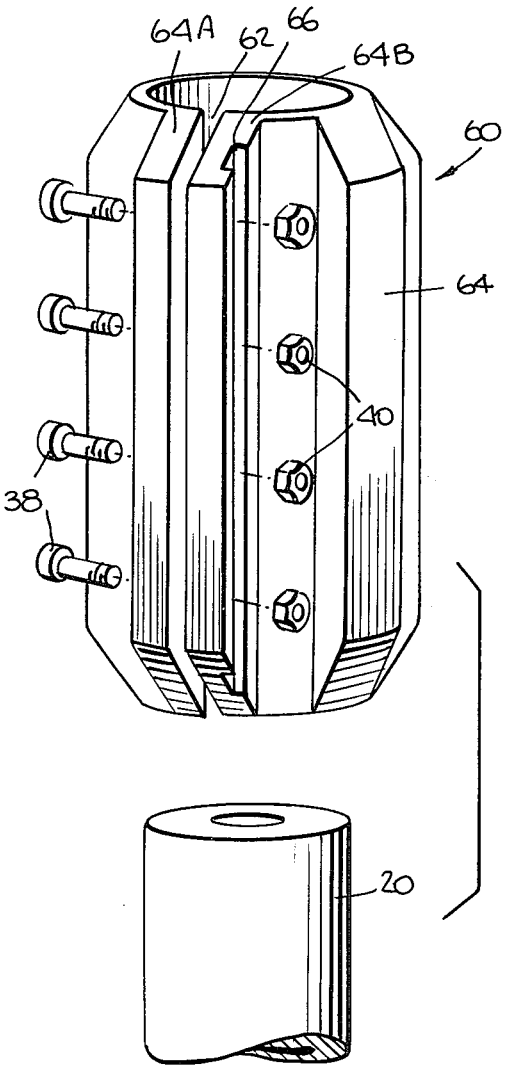
FIG. 10 is a perspective view of a stabilizer according to another embodiment of the invention.
Figure 11:
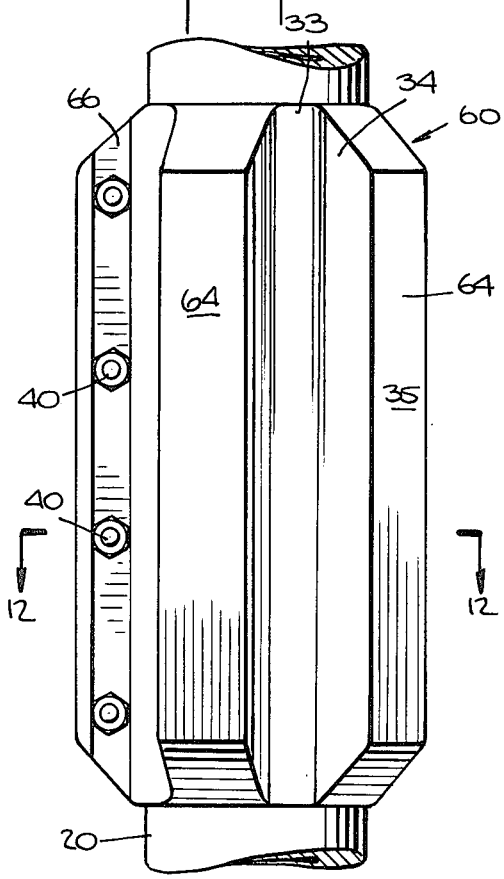
FIG. 11 is perspective view of the stabilizer of FIG. 9 secured to a drill collar.
Figure 12:
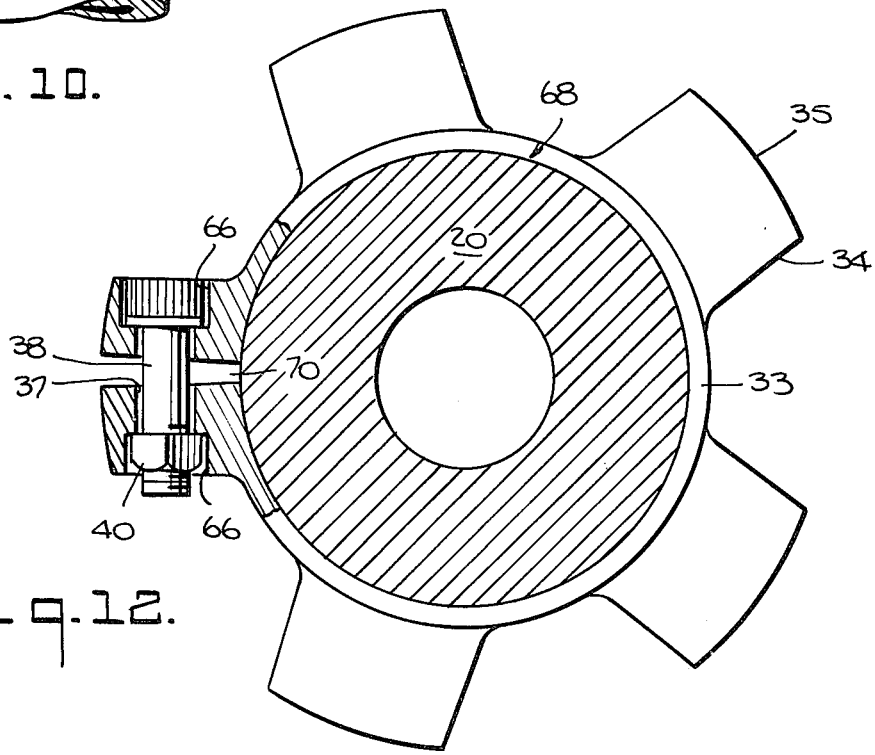
FIG. 12 is a cross-sectional view taken along lines 12—12 of FIG. 11.

In the embodiment of the invention shown in FIGS. 10–12, stabilizer 60 includes an axially, linearly extending open slot or split 62. Stabilizer 60 comprises spaced straight blades 64 which also extend axially with respect to opening 60 of the stabilizer. The stabilizer blades are spaced to enable drilling fluid to pass therebetween. The stabilizer 60 is secured to a drill collar 20 in the same manner as described for stabilizer 26 by means of bolts 38 and nuts 40. Stabilizer 60 can be provided with an axially extending slot 66 in the sides of the blades 64 A, B facing away from the slot 62.

Drill collars currently being manufactured, can, for example, have an outside diameter of approximately eight inches. Advantageously, the stabilizers are sized to fit such drill collars; however, drill collars after a period of use may have on outside diameter of approximately $7\frac{7}{8}$ inches or $7\frac{3}{4}$ inches due to wear. In order to mount the same stabilizer on these smaller diameter collars, a tubular shim 68 (FIG. 12) can be utilized. The shim is of cylindrical form having an axially extending split 70. For a $7\frac{3}{4}$ inch collar, the thickness of the shim by way of example could be approximately $\frac{1}{8}$ inch while the split 70 could be approximately $\frac{1}{2}$ inch in width. Shim 68 is initially placed around drill collar 20 and then the stabilizer is placed about the shim. Tightening of bolts 38 causes the stabilizer to clamp the shim directly to the outer surface of the drill collar.

The radial gap between the stabilizer and a drill collar before the stabilizer is tightened onto the drill collar is approximately $\frac{1}{2}$ inch for an eight inch outside diameter drill collar, and approximately $\frac{7}{8}$ inch for a drill collar worn to about $7\frac{7}{8}$ inches.

The stabilizer shown in FIGS. 5–8 has its helical blades 32 overlapping, that is a line extending along the length of the stabilizer intersects at least two different blades. In the alternative, the stabilizer blades may extend helically and not overlap. Overlapping maintains continuous engagement of blades with the inner surface of the bore hole. If there is no overlapping, or straight blades are used, the blades may intersect the walls of the bore hole on a random basis.

In order to permit magnetic monitoring of the bore hole, the drill collars can be made of a non-magnetic material such as stainless steel, Monel material, etc. The stabilizer according to the invention provides an additional advantage in that it can also be made of non-magnetic material. The stabilizer of the invention functions equally well whether of magnetic or non-magnetic material since the clamping engagement of the invention can secure the stabilizer without the possibility of galling and fretting corrosion.

The stabilizer according to the invention is easily secured to a drill collar and may be positioned at any axial location thereof. Additionally, the stabilizer according to the invention will not separate from the drill collar even if all the fasteners fail since the stabilizer is of one piece, generally tubular, which encloses the drill collar. Moreover, the nuts and bolts which clamp the stabilizer to the drill collar are prevented from falling into the bore hole should they fail or become loose.

The advantages of the present invention, as well as certain changes and modifications of the disclosed embodiments thereof, will be readily apparent to those skilled in the art. It is the applicants' intention to cover by their claims all those changes and modifications which can be made to the embodiments of the invention herein chosen for the purposes of the disclosure without departing from the spirit or the scope of the invention.

What is claimed is:

1. A stabilizer for an elongated tubular assembly for rotatably driving a well drill bit within a bore hole comprising:

(a) a hollow cylindrical body of hard material having a wall portion with an opening extending centrally throughout the length thereof substantially corresponding to the external transverse dimensions of the elongated tubular assembly and adapted to receive a length of the elongated tubular assembly therein, the wall portion being of a thickness so as to be deflectable;

(b) means formed of rigid material disposed upon the outer portion of the hollow cylindrical body and extending substantially along the length thereof for bearing upon the interior surface of a bore hole to stabilize the elongated tubular assembly within the bore hole when rotatably driving the well drill bit, said bearing means formed of rigid material having a slot extending throughout the length of the hollow cylindrical body within the length of the bearing means and intersecting the opening of the hollow cylindrical body; and (c) means adapted to engage the bearing means adjacent one side of the slot and to extend across the slot to engage the bearing means adjacent the other side of the slot for varying the size of the opening to tighten the deflectable hollow cylindrical body into clamping engagement with the external surface of the elongated tubular assembly, the clamping engagement enabling the stabilizer to be fixedly positioned along the length of the elongated tubular assembly and to withstand torque and linear forces applied to the stabilizer in response to the engagement of the bearing means with the interior surface of a bore hole.

2. A stabilizer in accordance with claim 1 in which the bearing means formed of rigid material disposed upon the outer portion of the hollow cylindrical body comprises a plurality of elongated blades spaced apart from one another and extending substantially in the direction of the longitudinal axis of the hollow cylindrical body, each blade having an outwardly facing land for bearing upon the interior surface of the bore hole and forming a groove with respect to the blade adjacent thereto, the groove being adapted to provide a flow path for drilling fluid between the outer portion of the hollow cylindrical body and the interior surface of a bore hole.

3. A stabilizer in accordance with claim 2 in which the surface of the end of each blade contains wear-resistant material.

4. A stabilizer in accordance with claim 2 in which the length of each blade extends substantially parallel to the longitudinal axis of the hollow cylindrical body.

5. A stabilizer in accordance with claim 2 in which the length of each blade extends at an angle to longitudinal axis of the hollow cylindrical body.

6. A stabilizer in accordance with claim 2 in which the length of each blade extends substantially in the form of a helix.

7. A stabilizer in accordance with claim 2 wherein said means adapted to engage the hollow cylindrical body comprise a plurality of threaded bolts, a plurality of mating nuts and a plurality of pairs of registered holes disposed in said one blade adjacent said slot for receiving the plurality of bolts and mating nuts.

8. A stabilizer in accordance with claim 7, wherein said bolts have socket heads.

9. A stabilizer in accordance with claim 7, wherein said openings are counter-bored and a respective nut and socket head bolt are disposed in each counter-bored opening.

10. A stabilizer in accordance with claim 9, wherein said nut and said counter-bored opening form an interference fit such that upon tightening said bolt, said nut is forceably drawn into said counter-bored opening and engaged therein whereby said nut is retained in said counter-bored opening independently of said bolt.

11. A stabilizer in accordance with claim 9 and including a flexible retainer member disposed in said counter-bored opening adjacent the socket head of the bolt, said retainer member being springedly engaged in said counter-bored opening whereby said bolt is prevented from axially moving out of said opening.

12. A stabilizer in accordance with claim 9, wherein the counter-bored openings are formed by a slot extending along the openings.

13. A stabilizer for an enlongated tubular assembly for rotatably driving a well drill bit within a bore hole comprising:

(a) a hollow cylindrical body of hard material having a wall portion with an opening extending centrally throughout the length thereof substantially corresponding to the external transverse dimensions of the elongated tubular assembly and adapted to receive a length of the elongated tubular assembly therein, the wall portion being of a thickness so as to be deflectable;

(b) means formed of rigid material disposed upon the outer portion of the hollow cylindrical body and extending substantially along the length thereof for bearing upon the interior surface of a bore hole to stabilize the elongated tubular assembly within the bore hole when rotatably driving the well drill bit, the bearing means comprising a plurality of elongated blades spaced apart from one another and extending substantially in the direction of the longitudinal axis of the hollow cylindrical body, each blade having an outwardly facing land for bearing upon the interior surface of the bore hole and forming a groove with respect to the blade adjacent thereto, the groove being adapted to provide a flow path for drilling fluid between the outer portion of the hollow cylindrical body and the interior surface of a bore hole, said bearing means formed of rigid material having a slot extending throughout the length of the hollow cylindrical body within the length of one of the blades and intersecting the opening of the hollow cylindrical body; and (c) means adapted to engage said one blade adjacent one side of the slot and to extend across the slot to engage said one blade adjacent the other side of the slot for varying the size of the opening to tighten the deflectable hollow cylindrical body into clamping engagement with the external surface of the elongated tubular assembly, the clamping engagement enabling the stabilizer to be fixedly positioned along the length of the elongated tubular assembly and to withstand torque and linear forces applied to the stabilizer in response to the engagement of the bearing means with the interior surface of a bore hole.

14. A stabilizer in accordance with claims 1 or 13 in which the slot is open and intersects the exterior of the stabilizer.

15. A stabilizer in accordance with claims 1 or 13 in which the hollow cylindrical body has a wall thickness which is relatively small compared to the external transverse dimensions of the stabilizer, the relatively small wall thickness enabling the hard material to be deflected by the means adapted to engage the hollow cylindrical body to clamp the stabilizer along the length of the elongated tubular assembly.

16. A stabilizer in accordance with claims 1 or 13 in which the hard material of the hollow cylindrical body is metal material.

17. A stabilizer in accordance with claims 1 or 13 in which the slot extends substantially parallel to the longitudinal axis of the hollow cylindrical body.

18. A stabilizer in accordance with claims 1 or 13 in which the slot extends substantially at an angle to the longitudinal axis of the hollow cylindrical body.

19. A stabilizer in accordance with claims 1 or 13 in which the slot is substantially in the form of a helix.

20. A stabilizer in accordance with claims 1 or 13, wherein said hollow cylindrical body and said bearing means formed of rigid material are of non-magnetic material.

21. A stabilizer in accordance with claim 20, wherein said hollow cylindrical body and said bearing means formed of rigid material are of stainless steel material.

22. A stabilizer in accordance with claim 20, wherein said hollow cylindrical body and said bearing means formed of rigid material are of a nickel-copper alloy material.

* * * * *

UNITED STATES PATENT AND TRADEMARK OFFICE

CERTIFICATE OF CORRECTION

PATENT NO. : 4,275,935

DATED : June 30, 1981

INVENTOR(S) : Charles M. Thompson, et al.

It is certified that error appears in the above-identified patent and that said Letters Patent are hereby corrected as shown below:

Column 2, line 4, delete "the" and insert --to--

Column 7, line 44, delete "7/8" and insert --1/8--

Signed and Sealed this

*Sixth* Day of *October 1981*

[SEAL]

*Attest:*

GERALD J. MOSSINGHOFF

*Attesting Officer*

*Commissioner of Patents and Trademarks*